US005348791A

United States Patent [19]

Thompson et al.

[11] Patent Number: 5,348,791

[45] Date of Patent: Sep. 20, 1994

[54] FOLDABLE WATERPROOFING STRUCTURE

[75] Inventors: Peter J. Thompson, Purley; Timothy J. Martin, Loxwood, both of England

[73] Assignee: W. R. Grace Limited, London, England

[21] Appl. No.: 71,212

[22] Filed: Jun. 2, 1993

Related U.S. Application Data

[63] Continuation of Ser. No. 766,894, Sep. 26, 1991, abandoned, which is a continuation of Ser. No. 343,478, Apr. 26, 1989, abandoned.

[30] Foreign Application Priority Data

May 4, 1988 [GB] United Kingdom ..... 8810489.8

[51] Int. Cl.[5] ..... B32B 3/16; B32B 3/30; B32B 5/18; B32B 7/12

[52] U.S. Cl. ..... 428/184; 428/116; 428/169; 428/182; 428/186; 428/317.1; 428/317.3; 428/354; 428/468; 428/489

[58] Field of Search ..... 428/489, 162, 182, 343, 428/351, 354, 468, 169, 184, 160, 186, 188, 73, 119, 116, 41, 42, 40, 181, 189, 317.1, 317.3

[56] References Cited

U.S. PATENT DOCUMENTS

| | | | |
|---|---|---|---|
| 3,906,137 | 9/1975 | Bauer | 428/119 |
| 4,102,720 | 7/1978 | Kaneko et al. | 428/186 X |
| 4,125,656 | 11/1978 | Creamer | 428/181 X |
| 4,338,151 | 7/1982 | Hutter, III | 428/42 X |
| 4,386,981 | 6/1983 | Clapperton | 428/41 X |
| 4,565,723 | 1/1986 | Hirsch | 428/71 |
| 4,565,724 | 1/1986 | Smits | 428/489 X |
| 4,617,221 | 10/1986 | von der Chys | 428/489 X |
| 4,657,611 | 4/1987 | Guins | 428/186 X |
| 4,670,071 | 6/1987 | Cooper et al. | 428/137 X |
| 4,731,284 | 3/1988 | Hailer et al. | 428/489 X |
| 4,751,122 | 6/1988 | May | 428/41 |
| 4,812,349 | 3/1989 | Muelbeck | 428/489 X |
| 4,911,975 | 3/1990 | Schult | 428/489 X |
| 4,992,334 | 2/1991 | Kindt et al. | 428/489 |
| 5,069,950 | 12/1991 | Crookston, Sr. | 428/167 X |
| 5,142,837 | 9/1992 | Simpson et al. | 428/189 X |

FOREIGN PATENT DOCUMENTS 1369326 8/1972 United Kingdom .

*Primary Examiner*—Daniel R. Zirker
*Attorney, Agent, or Firm*—Craig K. Leon; William L. Baker

[57] ABSTRACT

A Structure comprising a membrane of a waterproofing pressure sensitive adhesive material with, contiguous thereto, a layer of relatively rigid covering material so arranged and divided into segments that the structure can be folded at the divisions between the segments.

6 Claims, 4 Drawing Sheets

FOLDABLE WATERPROOFING STRUCTURE

This is a continuation of co-pending application Ser. No. 07/766,894 filed on Sep. 26, 1991, now abandoned, which was a continuation of Ser. No. 07/343,478 filed on Apr. 26, 1989 now abandoned.

This invention relates to waterproofing structures and their use.

BACKGROUND OF THE INVENTION

Preformed self-adhesive waterproofing structures are known which comprise a sheet like substrate, which typically is of waterproof plastics material, such as polythene or polyethylene, having contiguous therewith a layer of a self adhesive waterproofing material which typically is a bituminous compound such as a mixture of bitumen and rubber.

Such structures are normally supplied in the form of rolls, being flexible, with a release sheet attached to the exposed surface of the self-adhesive compound. The material is applied by unrolling, simultaneously removing the release sheet and brushing the material out so that it entirely contacts the surface being covered. Normally, adjacent strips are lapped with the edge of one overlapping the edge of its neighbour.

In some circumstances such structures can be difficult to apply. For instance, application to vertical surfaces can be difficult due to the fact that the adhesive is very tacky and the material heavy and flexible. Horizontally extending strips of material are often called for on vertical surfaces and the application of these in particular can pose problems.

As mentioned, the known structures typically have a plastic sheet material as the substrate to which the self adhesive membrane is attached. Whether used on horizontal or vertical surfaces these structures, although waterproof, do have mechanical limitations. For instance, in basement construction, the first layer of concrete for the floor is covered with the waterproofing structure. However there may be some time between the application of this covering and subsequently covering the structure with a screed or other flooring substance or with another layer of concrete. During that period the uppermost plastics substrate needs to be protected because tradesmen require access and so foot traffic must be expected. On vertical walls, the waterproofing structure may be applied to the exterior of a subterranean concrete wall. The space between the ground and the wall is subsequently backfilled and the material used for this may include quite sharp aggregate likely to puncture the plastic sheet substrate. Thus, there is a need to protect the substrate and this may presently be done by using a protecting board attached to the plastic substrate sheet using a curable adhesive. Such boards may comprise bitumen impregnated felts optionally provided with filler such as cork. Alternatively the risk is run that the plastic substrate, and perhaps the entire structure, will be ruptured, leading to the possibility of moisture penetration in the future.

SUMMARY OF THE INVENTION

According to the present invention there is provided a structure comprising a membrane of waterproofing pressure sensitive adhesive material with, contiguous thereto, a layer of relatively rigid covering material so arranged and divided into segments that the structure can be folded at the divisions between the segments.

By "relatively rigid covering material" we mean a material of such stiffness that the structure will not buckle and will not bend very much, under its own weight, for instance if held at one edge, in contrast to the known materials which are easily bent and will droop through a large angle if supported only at the edge. The relatively rigid, covering material has the advantage that it provides, integrally in the waterproofing structure, a strengthening and protecting layer which can withstand satisfactorily foot traffic and the abrasive effects of any backfilling there may be when the material is used at an external or subterranean surface. In addition, structures of the invention are easy to apply.

The division between segments may be complete separation, or just a cut or groove through part of the thickness allowing folding between segments. For instance, a fold line can be created by nip-folding, that is crushing locally along a line.

By arranging the materials so that alternate folds are in opposite directions the structure can be supplied in a concertina folded arrangement, in which it Is easily applied to a surface to be covered and protected, the application perhaps being easier than with the more flexible rolls of material which lack the rigid layer. Alternatively, the structure may be rolled up, for instance around a central core, with the adhesive on either the inside or, preferably, the outside. The core diameter will usually be greater than the segment width or order to make such a rolled-up arrangement feasible. Preferably the covering material is lightweight and has a continuous skin in contact with the adhesive membrane. A particularly suitable form of covering material is a twin-walled material, that is to say a material having two walls spaced apart and connected by a plurality of intermediate transverse ribs which divide the space between the walls into parallel channels, the distance between the two walls being about 2 to 10 mm, or more, preferably about 4 mm. The spacings between the adjacent ribs will normally De similar to the spacing between the walls. Materials of this type, which are in themselves known and made of plastics material, have a very high strength to weight ratio and are very strong against crushing of the two walls, so that a man may jump up on them without crushing the walls together.

With this preferred covering material, to allow the folding to occur at each foldline one of the walls may be slit, so that the other one remains continuous, and the folding takes place along the line of that one of the parallel channels which is thus opened. The membrane may be outside the fold if the outer wall is slit, and inside the fold if the inner one is slit. To ensure that the pressure sensitive adhesive membrane is capable of withstanding folding, particularly when it is on the outside of a fold line in the concertina formation, it may be reinforced with a high tensile strength reinforcing net, layer, for instance a sheet or for instance of polypropylene, but glass or other fibre woven or nonwoven reinforcements are other possibilities. Reinforcement can also help with lap jointing. In addition, in order better to ensure continuity of covering material, a continuous film can be applied between the self adhesive membrane and the relatively rigid covering material. Alternatively, such a film could be intermittently applied, for instance beneath the covering material in the region of each fine.

Other preferably lightweight relatively rigid materials can be used for the covering material such as bitumen impregnated felts or other sheets, optionally with fillers, but with thickness of up to 4 or perhaps 6 mm order to avoid excessive weight. Alternative rigid coverings are faced hard-board, and rigid foam insulating board for instance of cross-linked polyethylene, polyurethane or expanded polystyrene. These can be applied in separate segments to the adhesive membrane with the folding occurring between the segments or can be created to have a continuous sheet surface in contact with the membrane.

For the pressure sensitive adhesive membrane is possible to use membranes of adhesive material which enable the structures when pressed by normal hand pressure against for instance a concrete surface, without any prior treatment of the membrane or the concrete, to remain stuck thereto. Alternatively, adhesives which require prior surface treatment e.g. with a primer, can be used. Suitably the membrane of adhesive is 0.5 to 3 or 4 min. thick but in certain circumstances a thickness down to 0.25 mm thick may be employed. Below that thickness secure adhesion and integrity of the waterproofing membrane may not be maintained.

Bituminous adhesives are generally suitable for the membrane and may be formed of natural or synthetic rubber, virgin or reclaimed, blended into bitumen to provide a smooth mix. The ratio by weight of bitumen to rubber is preferably from 80:20 to 95:5 especially about 90:10. Other types of adhesive composition could be used. Generally, suitable compositions of adhesive have softening temperatures measured by the Ring and Ball method of 70° to 130° C.

A removable paper or other coating is normally required on structures of the invention to cover the surface of the adhesive membrane remote from the rigid covering sheet. This can be siliconised paper or another release sheet.

When applied to an exterior vertical surface a still further function may be performed by structures according to the invention, particularly those which have the twin-walled covering material. This is achieved if the exterior wall of the relatively rigid covering sheet is rendered at least to a small extent perforated allowing access to drainage passages or paths within the relatively rigid material. This will allow land water to penetrate into this sheet and drain downwards, for instance through the parallel channels, out of contact with the exterior of the wall. To this end, if the twin walled covering sheet is employed the exterior wall can be penetrated at intervals so as to allow access to the parallel channels, the perforations being thermally or mechanically made, the source of heat being electrical or by flame.

With the twin walled parallel channel covering material, impregnation with foam could be employed by an extrusion process.

Adjacent structures of the invention can be lap jointed. To this end, part or all the rigid covering along one on both edges involved in the lap joint can be removed so that the lap joint does not stand proud of the remainder. Alternatively double sided adhesive waterproofing tape, applied in a pattern where the edges of material will be, can be pre-positioned on the surface to be covered with no need then to provide an edge free of rigid covering. Such a tape can also be used beneath adjacent sections of structure of the invention which are inclined to each other, e.g. at the bottom of a wall and on an adjacent floor. Such tape should be thin in order to avoid bending the rigid covering.

DESCRIPTION OF THE DRAWINGS

In order that the invention may be more clearly understood the following description is given by way of example only with reference to the accompanying drawings in which.

DETAILED DESCRIPTION OF THE INVENTION

Figure 1:
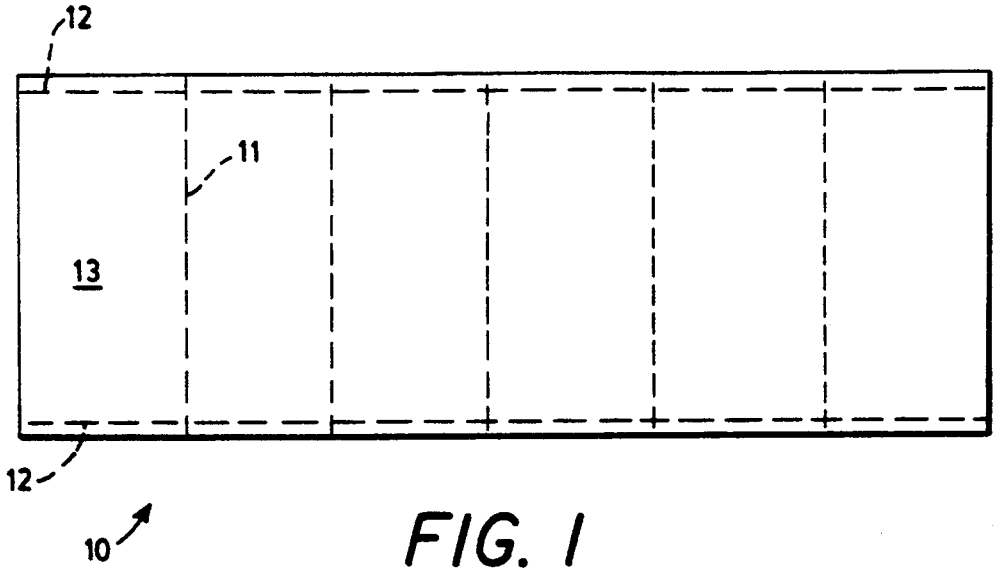
FIG. 1 is a top plan view of a structure according to the invention.
Figure 2:
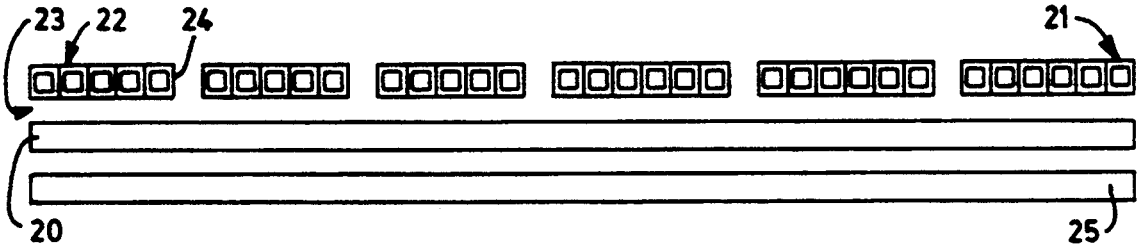
FIG. 2 is a side view of structure of FIG. 1, shown schematically with normally contiguous parts spaced apart for each of understanding.

Shown in FIG. 1 is a structure 10 having in this instance six segments such as 13 separated by fold lines 11 and having margins 12 of reduced thickness. The structure, as shown in FIG. 2, comprises a self-adhesive membrane 20 typically of bituminous rubber material, and the six segments shown at 21 are formed from a continuous twin walled sheet with upper and lower walls 22 and 23 separated by a plurality of parallel transverse walls 24 which define a plurality of parallel channels in the material. A release sheet is shown at 25.

At the fold lines the outer wall 22 or the inner wall is interrupted such that folding can take place. Folding is such as to open up the cut, i.e. the adhesive membrane is on the inside of the fold when the cut is in the outer wall. Folding can be performed so as to give a roll of material or in the manner shown in FIG. 3 in a concertina fold. The structure can be applied by removing the release sheet 25, not shown in FIG. 3, successively from the folded segments of the self adhesive material 20. Alternatively the folds instead of being in alternate directions could all be in the same direction with a view to forming a roll comprising a plurality of segments of the structure and which can be unwound as it is layed.

A suitable twin walled material is of polypropylene, 2 to 10 mm, preferably about 4 mm thick. It is laminated to the bitumen compound which can have a reinforcing mesh within it, which is particularly important to give it reinforcement at the folds. This material is very strong, it can readily withstand foot traffic and indeed can withstand impact from quite sharp objects without collapsing or puncturing so that the waterproofing function is maintained under all normal circumstances. The material offers a continuous sheet substrate in immediate contact with the adhesive membrane 20. Application can be easier than with the prior art rolls, as it is more easy to align each segment correctly before placing it in contact with the surface to be covered. A result of the channel formation is that any leakage due to a defect in the membrane does not spread laterally.

Figure 4:
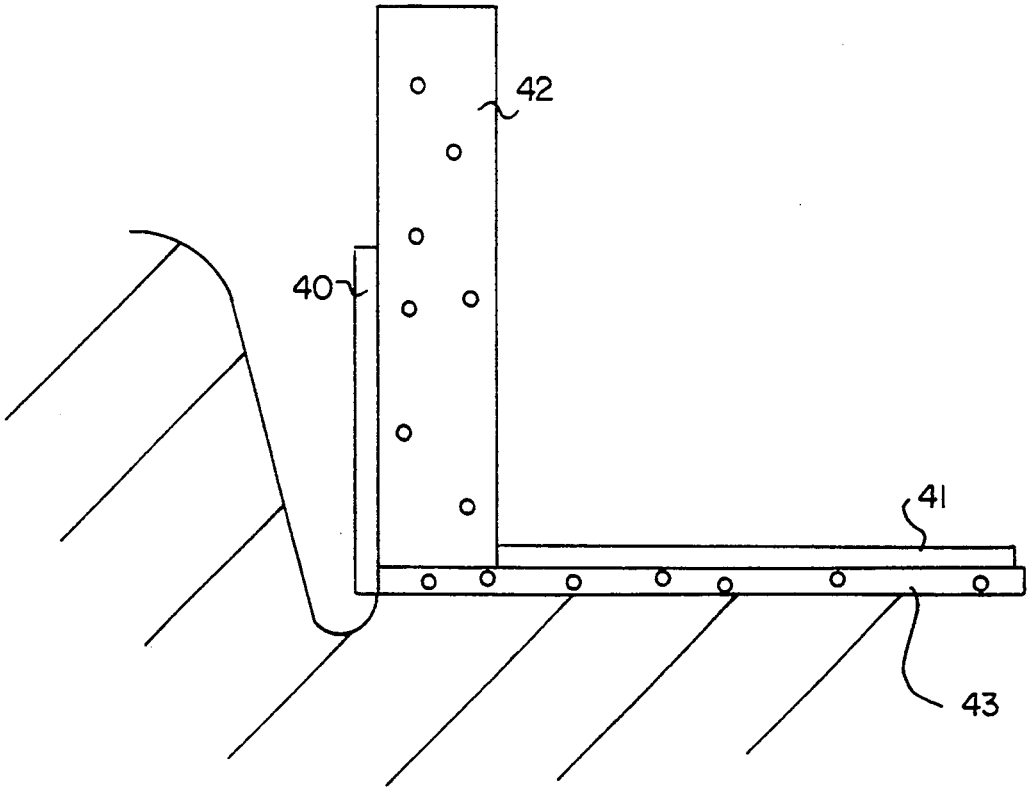
FIG. 4 is an illustration of the location of structures according to the invention in one possible situation.
Figure 8:
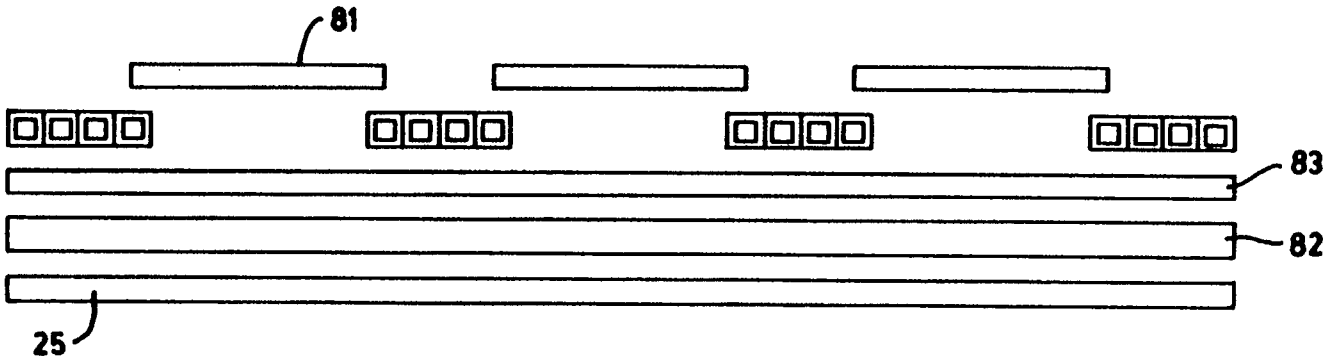

A drainage facility can be introduced by perforating the outer wall 22 so as to allow access to the channels between the transverse walls 24. This is particularly useful in vertical exterior applications. Perforation can be with hot pins to melt material away. Other forms of relatively rigid material can also be adapted to give a drainage facility. Such applications are illustrated in FIG. 4, which shows a vertical wall 42 and a horizontal blinding layer 43 of a basement structure arranged in a dug out portion of the ground. On the exterior of the vertical wall 42 is secured a structure 40 according to the invention which thus has the effects of waterproofing, mechanically protecting and draining land water from the adjacent surface of the concrete. Above the horizontal bottom wall or blinding layer 43 is also applied a structure 41 according to the invention to provide a waterproofing function, while being protected against damage whilst work proceeds before and in preparation for laying a layer of concrete thereon. Folding may also be achieved by omitting parts of the covering material between segments thereof as shown in FIG. 8. These resulting gaps can then be covered by a scrim or mesh 81 to keep particles away from the membrane, 82 and the scrim or mesh could be stretched or squashed as appropriate on folding. In this case a continuous film 83 is between membrane and segments, with a suitable adhesive system employed to retain the covering material on the film 83.

Figure 5:
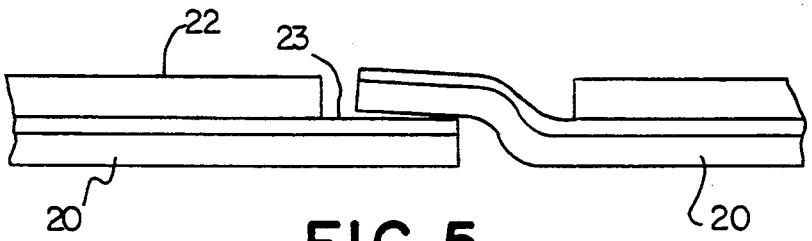
FIG. 5 shows a detail of structure edges in a lap joint.

Reverting to FIG. 1, on each edge of the structure is a margin of reduced thickness 12. In FIG. 5 is shown on an enlarged scale a lap joint between the edges of adjacently laid structures of the invention. In the left hand structure the upper wall 22 of the membrane is terminated a short distance from the edge of the self adhesive membrane 20 although the lower wall 23 of the membrane continues right up to that edge. The edge of the right hand structure laps over, and is similar in construction.

The invention extends to methods of waterproofing surfaces by applying a covering of a plurality of structures according to the invention, with or without lap jointing between them.

Figure 6:
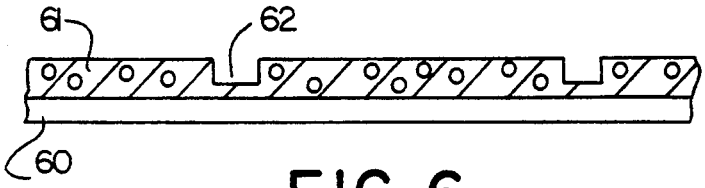
FIG. 6 is a partial sectional view of another embodiment.

FIG. 6 shows part of another embodiment of a structure of the invention. An adhesive membrane 60 of the same type as before has a foam or board covering 61 divided into segments by grooves 62; the covering being continuous but thin enough in the areas of the grooves 62 to fold without rupture.

Figure 3:
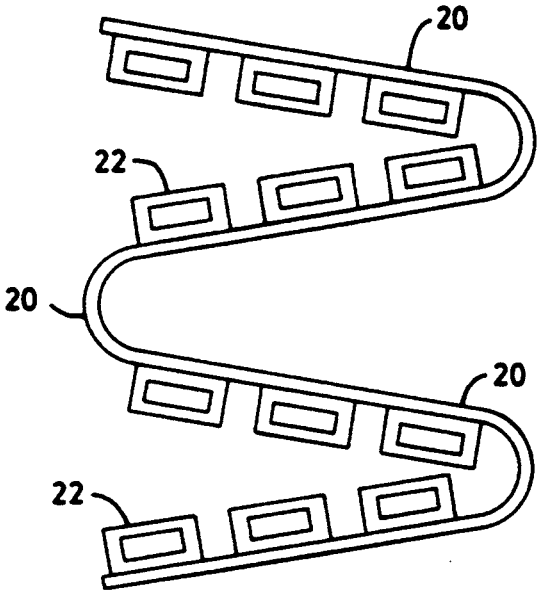
FIG. 3 illustrates schematically a concertina-folded structure of the invention.
Figure 7:
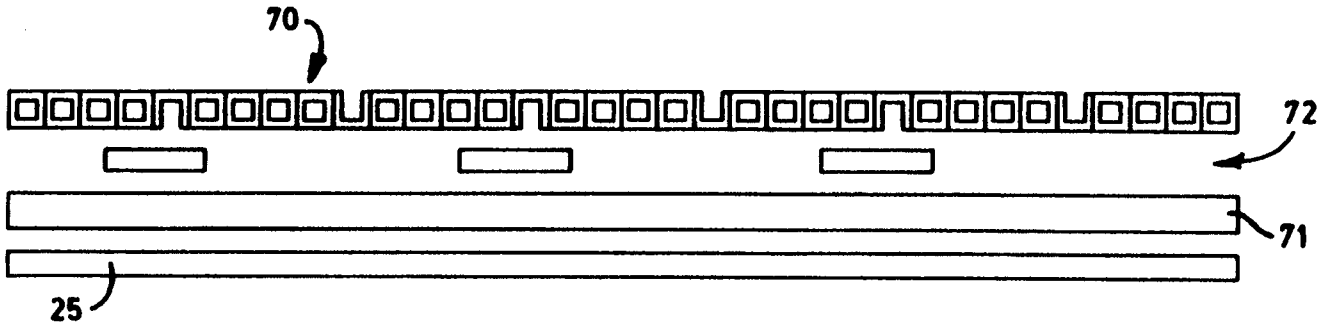
FIGS. 7 and 8 are views similar to FIG. 2 of alternative embodiments of structure of the invention.

FIG. 7 shows an embodiment with the rigid material 70 cut to form segments in alternate faces, so as to facilitate concertina type folding as shown in FIG. 3. Beneath cuts on the side adjacent the membrane, here shown at 71, are provided elastic film strips 72, adhered to the membrane and desirable also adhered to the rigid material by a suitable adhesive system, to ensure maintainance of moisture-proofness.

Figure 9:
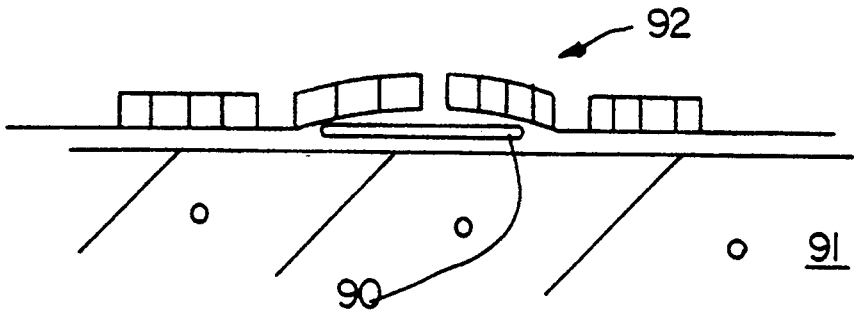
FIG. 9 is a detail of structure edges at another type of joint.

FIG. 9 shows use of a double sided adhesive strip 90 on a concrete surface 91 where adjacent structures 92 of the invention meet; such structures in this case do not have edges free of rigid covering material.

To assist in detailing at complicated places a liquid applied waterproofing compound can be used.

Figure 10:
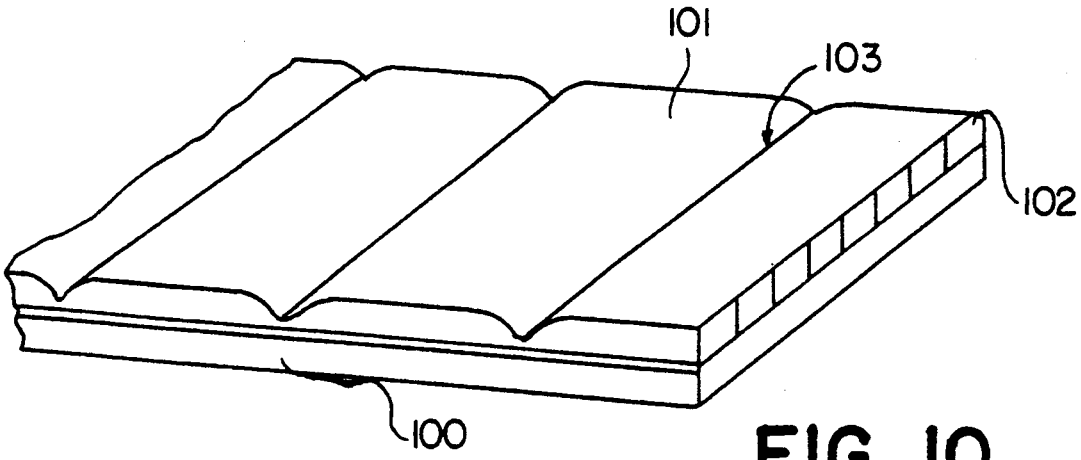
FIG. 10 is a perspective view of another embodiment including two further optional features of structures of the invention.

As an alternative to the above arrangement where the channels in the relatively rigid material are transverse to the length of the structure, embodiments of the invention may provide the channels parallel to that length. Thus, as shown in FIG. 10 there is a structure of the invention comprising a self adhesive bituminous substrate 100 and, contiguous thereto, a layer of rigid material 101 which has channels 102 defined between side walls, which channels are parallel to the length of the structure. The embodiment also illustrates another feature of the invention, which is that the fold lines between adjacent segments of the material 101 are provided by compressing the material, e.g. with a nip-roller or the like, rather than by cutting. Such nip-folding can be performed either transverse to or longitudinally of the channels where the relative rigid material is of the channel structure shown.

Embodiments such as that of FIG. 10 can also include, where applicable, features of other embodiments described above.

Embodiments with the channels extending longitudinally have the advantages that continuous length manufacture may be easier, water is not drained from the channels into the main, longitudinal, lap joints, interchange of liquid flow between channels is easier at the fold lines, and with vertical surfaces, vertical positioning of the structures gives vertical channels, as is of course desired for drainage.

It is possible for structures of the invention to be assembled on site rather than be factory made. Thus, a separate membrane having perhaps a substrate of plastics material can, in certain cases, be applied first to a surface to be protected and the remainder of the structure can be applied as a separate item subsequently and be adhered in place, for instance by an adhesive which it carries.

What is claimed:

1. A foldable waterproofing structure, comprising:

a continuous pressure-sensitive waterproofing adhesive membrane layer comprising bitumen and rubber; and a plurality of segments contiguous with said waterproofing membrane and spaced apart from each other so as to permit folding, in the manner of a concertina of the waterproofing structure between said segments, each of said segments comprising a material of such stiffness that it does not buckle or bend under its own weight and having a first wall contiguous with said waterproofing membrane, a second wall spaced apart from said first wall, and transverse ribs connecting said first wall to said second wall and forming a channel between said walls; and mesh, scrim, or film contiguous with or embedded within said continuous pressure-sensitive waterproofing adhesive membrane layer between said spaced-apart segments.

2. The structure of claim 1 wherein said second wall is perforated.

3. The foldable waterproofing structure of claim 1 wherein said mesh, scrim, or film is embedded within said continuous pressure-sensitive waterproofing adhesive membrane and thereby operative to reinforce said membrane.

4. The foldable waterproofing structure of claim 3 whereto said segments further comprise a foam within said segment channels.

5. The foldable waterproofing structure of claim 3 wherein said segments comprise more than one channel.

6. The foldable waterproofing structure of claim 3 wherein said segments are formed from polypropylene.

* * * * *